United States Patent [19]

Stahlecker et al.

[11] Patent Number: 4,796,421

[45] Date of Patent: Jan. 10, 1989

[54] ARRANGEMENT FOR OPEN-END ROTOR SPINNING

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 149,178

[22] Filed: Jan. 27, 1988

[30] Foreign Application Priority Data

Feb. 19, 1987 [DE] Fed. Rep. of Germany ..... 3705319

[51] Int. Cl.[4] ..... D01H 7/882

[52] U.S. Cl. ..... 57/417; 57/415

[58] Field of Search ..... 57/404, 411, 413–415, 57/417

[56] References Cited

U.S. PATENT DOCUMENTS 3,861,131 1/1975 Le Chatelier ..... 57/417
3,965,661 6/1976 Yoshida ..... 57/417
3,986,332 10/1976 Fukuda et al. ..... 57/417
4,499,719 2/1985 Faessler ..... 57/417
4,516,397 5/1985 Raasch et al. ..... 57/415 X
4,635,436 1/1987 Malina et al. ..... 57/415 X

FOREIGN PATENT DOCUMENTS 3332498 3/1984 Fed. Rep. of Germany .

*Primary Examiner*—John Petrakes
*Attorney, Agent, or Firm*—Barnes & Thornburg

[57] ABSTRACT

An open-end rotor spinning apparatus is provided which includes a spinning surface element. The spinning surface element is followed by a deflecting element having at least one false-twisting edge. A surface area is spaced opposite the deflecting element and includes a recessed area opposite the at least one false-twisting edge.

11 Claims, 1 Drawing Sheet

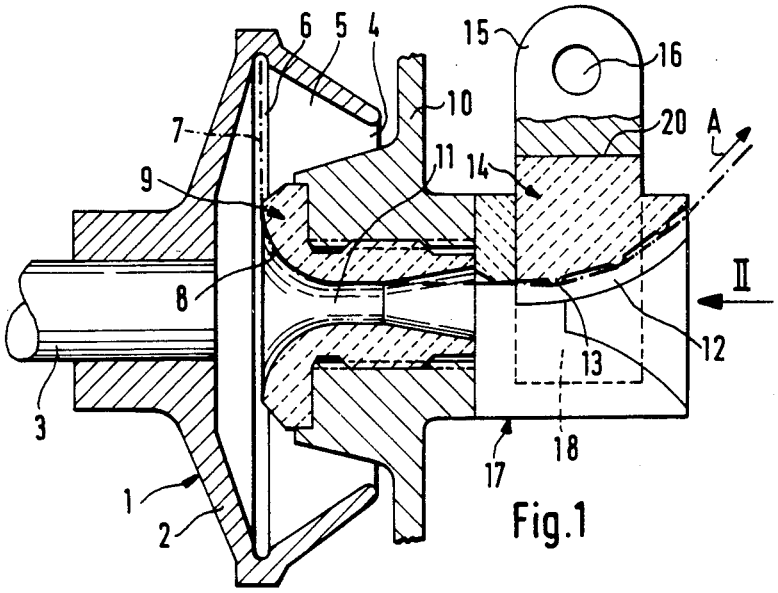
Fig.1
Fig. 2
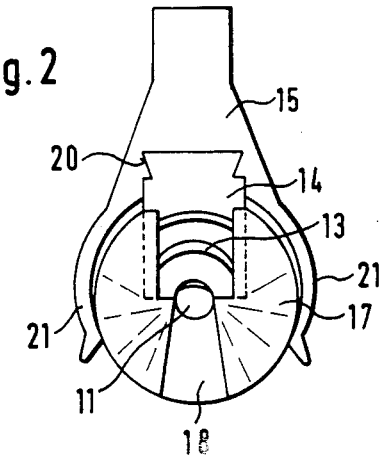

ARRANGEMENT FOR OPEN-END ROTOR SPINNING

BACKGROUND AND SUMMARY OF THE INVENTION

The invention relates to an apparatus for open-end rotor spinning having a spinning rotor into which a projection projects that is provided with a yarn withdrawal nozzle that is followed by an insert in moving direction of the yarn. The insert includes a deflection for the spun yarn that has at least one false-twisting edge.

In a known open-end rotor spinning arrangement (DE-OS No. 33 32 498), an insert with false-twisting edges is detachably inserted into a bend of a yarn withdrawal pipe. From the yarn that moves over the false-twisting edges, parts are rubbed off that are not moved away. This presents the danger of rubbed-off parts interfering with the quality of the yarn because the rubbed off parts at least occasionally are bound into the spun yarn, the rubbed-off parts hinder the return of a yarn end during piecing, and particularly during a piecing, the rubbed-off parts are conveyed back into the spinning rotor.

An object of the invention is to provide an open-end spinning apparatus such that interferences by accumulations of rubbed-off parts are avoided.

This object is achieved by providing a recessed area opposite the at least one false-twisting edge provided on a deflecting element. As a result, it becomes possible to collect the rubbed off parts of the deflected yarn at a point that does not interfere with the spinning process, nor with a piecing. In certain preferred embodiments, this recess can be formed by an enlargement of the diameter of a yarn withdrawal duct.

According to advantageous features according to certain preferred embodiments of the invention, the recess area opposite the at least one false-twisting edge is open in downward direction. As a result, the rubbed-off yarn parts can fall down from the area of the moving path of the yarn and, if necessary, can be collected or moved away by a special device. As a result, interferences with the spinning process or the piecing process are reliably excluded.

According to other advantageous features of certain preferred embodiments of the invention the recess area is configured as a longitudinal slot aligned in moving direction of the yarn opposite the at least one false-twisting edge. A longitudinal slot of this type is completely sufficient for moving away the rubbed-off parts.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial cross-sectional view of an open-end rotor spinning machine according to certain preferred embodiments of the invention having a spinning rotor and the parts that directly follow it in withdrawal direction of the yarn; and FIG. 2 is a view of a preferred embodiment according to FIG. 1 in the direction of the arrow II.

DETAILED DESCRIPTION OF THE DRAWINGS

The spinning rotor 1 shown in FIG. 1 has a rotor 2 that is arranged on a shaft 3 in a torsionally fixed way. The shaft 3 is disposed in a way that is not shown in detail and is equipped with a rotational drive. The rotor 2 has a double-cone shape. The largest cross-section is formed by a so-called fiber collecting groove 6 to which a sliding wall 5 connects. The sliding wall 5 tapers conically in the direction of the open edge 4 of the rotor 2. The fibers to be spun are fed onto the sliding wall 5 via a fiber feeding duct that is not shown. On the sliding wall 5, the fibers slide into the collecting groove 6 in which they are twisted together into a yarn 7 that is withdrawn coaxially with respect to the shaft 3 of the spinning rotor by means of a yarn withdrawal nozzle 9.

The spinning rotor 1 is normally located in a closed housing that is connected to a vacuum source that is not shown. This housing is closed off by a cover-type component 10 from which a projection protrudes that projects into the rotor 2. The projection of the cover-type component 10 contains the yarn withdrawal nozzle 9 that normally is made of a ceramic material. This withdrawal nozzle 9 has a funnel-shaped inlet opening 8 provided with a rounded part. A duct section 11 which is aligned coaxially with respect to the shaft 3 connects to the inlet opening 8. The withdrawal nozzle 9 is screwed into the projection of the component 10.

The yarn 7 spun in the spinning rotor 1 arranged on a horizontal shaft 3 is withdrawn coaxially with respect to the shaft 3, i.e., horizontally, in the yarn withdrawal nozzle 9 and is then deflected diagonally upwards in the direction of the arrow A. The withdrawing takes place by means of a pair of withdrawal rollers behind which a wind-up device is connected by which the spun yarn 7 is wound into a cross-wound spool (not shown).

After the yarn withdrawal nozzle 9, the deflection in the moving direction of the yarn 7 is formed by an insert 14 that preferably is also made of a ceramic material. This insert 14 contains a groove 12 with an approximately semicircular cross-section that is bent in moving direction of the yarn. Within this groove 12, three false-twisting edges 13 are arranged that are located at uniform distances behind one another. In certain preferred embodiments, these false-twisting edges 13 include ribs with an approximately semicircular cross-section that are inclined diagonally with respect to the moving direction of the yarn 7. The ascent of this slope is selected such that the false-twisting edges 13 extend approximately in parallel to the slope of the yarn twist. In certain preferred embodiments, in practice, the false-twisting edges 13 are arranged approximately at an angle of 45°.

By means of a guiding profile, the insert 14 is pushed into a dovetail-type guiding groove 20 that extends in the plane of the moving direction of the yarn. The guiding groove 20 is a component of a holding device 15 that is advantageously fastened at the component 10, for example, via a pin that reaches through a transverse bore 16 of the holding device 15.

A collecting piece or filling piece 17 is pushed onto component 10 from below and bridges the distance between the insert 14 and the component located in front of it, i.e., the end of the yarn withdrawal nozzle 9 or the cover-type component 10. As shown in FIG. 2, the collecting piece 17 has an approximately cylindrical outer circumference and is clamped tight by two clamp-type tabs 21 of the holding device 15.

In the area that is opposite the insert 14 and particularly opposite the false-twisting edges 13, the collecting piece 17 is provided with a recess formed as a longitudinal slot 18 so that the area located opposite the false-twisting edges 13 is open in downward direction. The area of the collecting piece 17 that is last in moving direction of the yarn is expanded to a funnel shape or is flared.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end rotor spinning apparatus comprising:

a spinning rotor rotatable about a substantially horizontal rotor axis and including a spinning surface means for forming yarn;

a yarn withdrawing means comprising a first part for receiving yarn and deflecting means downstream of said first part for deflecting yarn withdrawn from said rotor, said deflecting means including at least one false-twisting edge facing downwardly, and a fiber part collecting recess disposed below said deflecting means for collecting fiber parts rubbed off at the deflecting means without interfering with spinning and yarn withdrawal operations.

2. Apparatus according to claim 1, wherein said yarn withdrawing means is configured as a duct means with said deflecting means and recess disposed on opposite facing sides of said duct means.

3. Apparatus according to claim 1, wherein said first part of the yarn withdrawing means includes a yarn withdrawal nozzle means at its end facing the spinning surface means.

4. Apparatus as in claim 3, further including a projection element projecting into said spinning surface means, said yarn withdrawal nozzle means being disposed on said projection element.

5. Apparatus as in claim 1, wherein said recess includes a longitudinal slot aligned opposite said at least one false-twisting edge.

6. Open-end spinning apparatus comprising:

spinning surface means for forming yarn;

deflecting means for deflecting yarn withdrawn from said spinning surface means downstream from said spinning surface means in a yarn withdrawal direction, said deflecting means including at least one false-twisting edge; and a surface area spaced opposite said deflecting means, said surface area including a recessed area opposite said at least one false-twisting edge, wherein said surface area includes a longitudinal face arranged below said yarn being withdrawn, said longitudinal face including a longitudinal slot aligned opposite said at least one false-twisting edge, and a collecting piece, including said surface area, surrounding said deflecting means, said collecting piece including said longitudinal slot.

7. Apparatus as in claim 6, wherein said collecting piece has a funnel-shaped mouth through which said yarn is withdrawn.

8. Apparatus as in claim 6, further including a yarn guiding component disposed between said spinning surface means and said deflecting means, said collecting piece connecting said yarn guiding component to said deflecting means.

9. Apparatus as in claim 8, further including holding means for holding said deflecting means in place, said holding means including a slot into which at least a part of said deflecting means is inserted, said collecting means securing said deflecting means in said slot.

10. Apparatus as in claim 9, further including clamping means for holding said collecting piece in place.

11. Apparatus as in claim 10, wherein said clamping means is an extension of said holding means, said deflecting means being secured between said clamped collecting piece and said holding means.

* * * * *